US006113170A

United States Patent [19]

Daniel

[11] Patent Number: 6,113,170

[45] **Date of Patent: *Sep. 5, 2000**

[54] WRAP FOR BUNDLING OBJECTS

[76] Inventor: Dianne C. Daniel, 2515 Sonnington Dr., Dublin, Ohio 43016

[ * ] Notice: This patent is subject to a terminal disclaimer.

[21] Appl. No.: 09/080,703

[22] Filed: May 18, 1998

Related U.S. Application Data

[63] Continuation of application No. 08/671,490, Jun. 27, 1996, Pat. No. 5,853,212.

[51] Int. Cl.[7] ..... A63C 11/02

[52] U.S. Cl. ..... 294/147; 294/141; 294/165; 24/16 R

[58] Field of Search ..... 294/141, 146, 294/147, 148, 150, 165, 166; 24/16 R, 16 PB, 17 AP, 30.5 P, 30.5 T, 27, 300; 428/364, 372, 373, 375, 379, 398

[56] References Cited

U.S. PATENT DOCUMENTS

| | | | |
|---|---|---|---|
| D. 310,909 | 10/1990 | Bradtl | D3/36 |
| 2,118,875 | 5/1938 | Windheim | 224/5 |
| 2,530,695 | 11/1950 | Helmert | 224/5 |
| 3,257,054 | 6/1966 | Miesel | 224/56 |
| 3,426,393 | 2/1969 | Mead | 24/30.5 T |
| 3,768,711 | 10/1973 | Wilkinson | 224/45 |
| 3,947,927 | 4/1976 | Rosenthal | 24/81 SK |
| 3,960,302 | 6/1976 | Mazzoni | 224/45 S |
| 4,015,762 | 4/1977 | Mendillo | 224/45 S |
| 4,120,437 | 10/1978 | Hara | 224/45 |
| 4,463,885 | 8/1984 | Ball et al. | 224/250 |
| 4,483,470 | 11/1984 | Cousins | 224/257 |
| 4,484,378 | 11/1984 | Kimura et al. | 24/30.5 T |
| 4,488,748 | 12/1984 | Burkes | 294/147 |
| 4,531,661 | 7/1985 | Santy | 224/191 |
| 4,553,779 | 11/1985 | Shortridge | 294/147 |
| 4,856,689 | 8/1989 | Shore | 224/218 |
| 5,056,820 | 10/1991 | Des Prez | 294/147 |
| 5,104,017 | 4/1992 | Vandagriff | 224/205 |
| 5,190,336 | 3/1993 | Palz | 294/147 |
| 5,199,135 | 4/1993 | Gold | 24/17 AP |
| 5,437,401 | 8/1995 | Seltzer | 224/151 |
| 5,468,036 | 11/1995 | Brown | 294/147 |
| 5,590,422 | 1/1997 | Henderson | 132/273 |

OTHER PUBLICATIONS

"Toobers & Zots" Construction Toy , from "ZIPPY", no date given.

"Hair Twirlers", a sponge rubber hair care product, Kematic Industries & Co., no date given.

*Primary Examiner*—Dean J. Kramer

*Attorney, Agent, or Firm*—Standley & Gilcrest LLP

[57] ABSTRACT

The present invention is an apparatus and method for bundling and carrying snow ski equipment. The present invention is comprised of an elongate piece of first material having flexible qualities with a flexible strip of second, more rigid, and bendable material enclosed within the first material. The apparatus may be twist-tied around ski equipment for relatively easy transport.

11 Claims, 2 Drawing Sheets

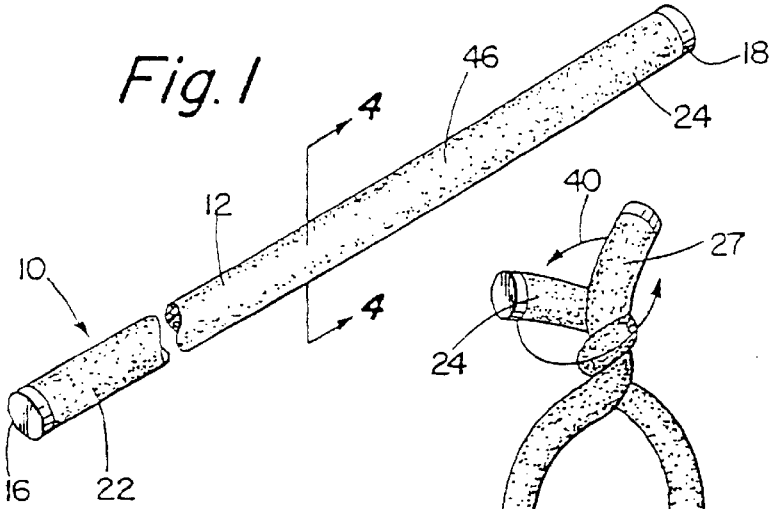
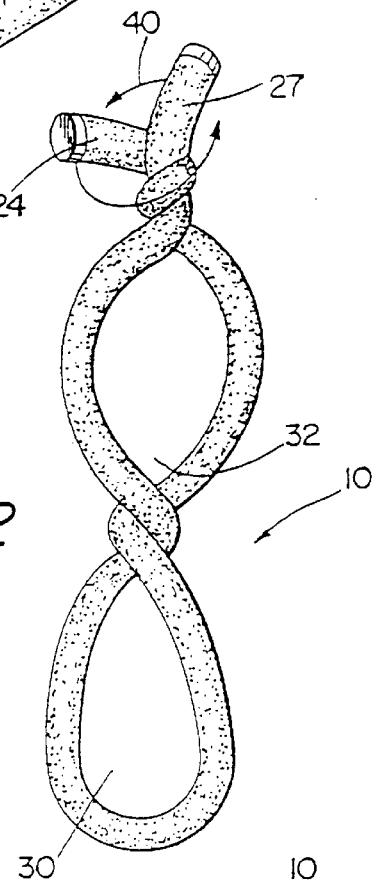
Fig. 2
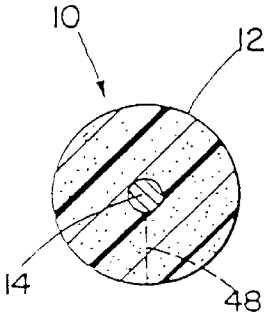
Fig. 4
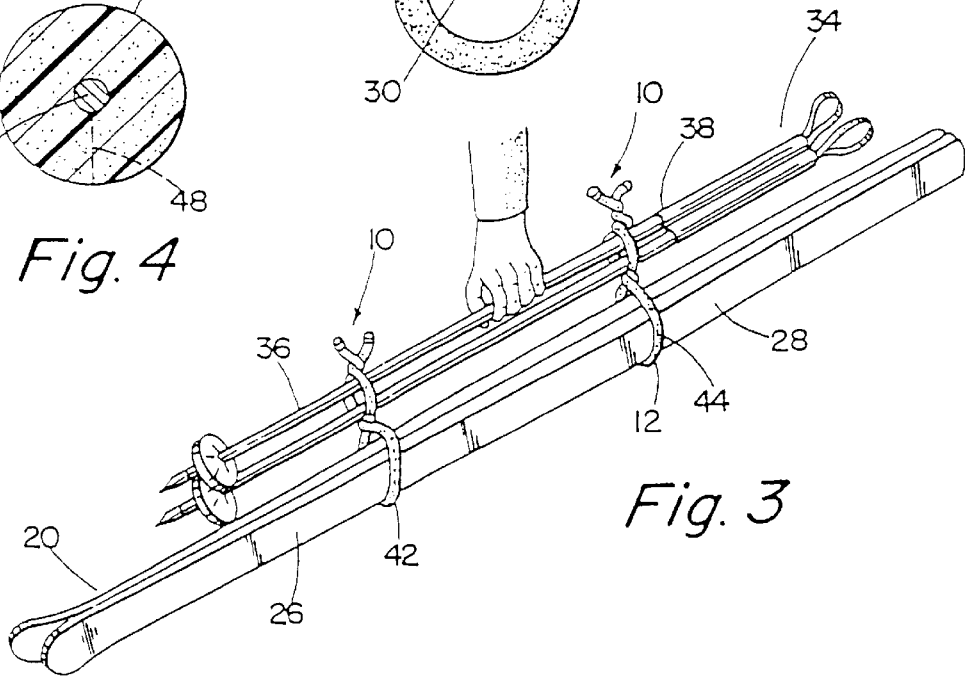
Fig. 3

WRAP FOR BUNDLING OBJECTS

This is a continuation of U.S. application Ser. No. 08/671,490, filed Jun. 27, 1996 now U.S. Pat. No. 5,853,212.

BACKGROUND AND SUMMARY OF THE INVENTION

The present invention relates generally to equipment transportation devices and methods, and more particularly, to a snow ski wrap for easy transport of snow ski equipment.

The joys of snow skiing can often be shadowed by the difficulties of carrying and transporting the heavy and bulky skis and ski poles. Known ski equipment carrying devices such as those disclosed in U.S. Pat. Nos. 3,960,302, 4,888,748, 2,530,695, 3,257,054, 5,468,036, 2,118,875, 3,768,711, 4,120,437, 4,463,885, 4,015,762, 4,856,689, 5,190,336, 5,437,401, 4,531,661, and 3,947,927 require some sort of elaborate buckling, strapping, or Velcro-connecting means for carrying ski equipment. All these known devices are lacking because:

1) they require relatively time-consuming construction prior to use;
2) they cannot be easily used while wearing heavy snow gloves;
3) they are all relatively detailed in construction;
4) some fail to secure the ski equipment while also preventing scratch damage to the equipment; and
5) many known devices are not easily stored on the person while skiing.

The present invention is comprised of a tube-like, elongate piece of first material having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece of first material encloses a flexible strip of second material having characteristics including, but not limited to, flexible qualities that allow the strip to retain its new shape when bent, such as a flexible wire. In the preferred embodiment, the tube-like, elongate piece of first material is a sponge (or foam) rubber piece which can be easily grabbed, or handled, while wearing heavy ski gloves. The flexible strip is bendable which allows the elongate rubber piece to retain its shape when bent. The elongate rubber piece is then twisted together to secure the snow skis. A second ski wrap may be similarly used to secure the opposite end of the snow skis. A pair of ski poles may then be placed in the spaces formed by the twisting of the ski wraps securing the snow skis. The ski wraps may again be twisted to secure the ski poles in place. The skier may then grab the ski poles and easily transport the ski equipment.

The rubber material preferably has a non-slip exterior surface which allows the ski equipment to be secured within the invention. Additionally, the rubber wrap does not scratch the expensive ski equipment while in contact with the equipment. The rubber wrap also slightly elevates the ski equipment from the ground which prevents damage to the ski equipment by abrasive asphalt or gravel.

The efficient design of the snow ski wrap allows for relatively easy manufacture. The design of the present invention also allows for easy maintenance and storage of the ski wrap when not in use. When not in use, the present invention may be stored in a user's pocket while skiing.

The present invention provides a much needed apparatus and method of easily securing and carrying ski equipment as well as other apparatus. In addition to the features mentioned above, objects and advantages of the present invention will be readily apparent upon a reading of the following description.

BRIEF DESCRIPTION OF THE DRAWINGS

Novel features and advantages of the present invention, in addition to those mentioned above, will become apparent to those skilled in the art, from a reading of the following detailed description in conjunction with the accompanying drawings wherein similar reference characters refer to similar parts and in which:

FIG. 1 is a perspective view of a preferred embodiment of the apparatus of the present invention;

FIG. 2 is a plan view of the apparatus of FIG. 1 in a twisted shape;

FIG. 3 is a perspective view of the apparatus of FIG. 1 in use;

FIG. 4 is a cross sectional taken along lines 4—4 in FIG. 1;

DETAILED DESCRIPTION OF THE PREFERRED EMBODIMENTS

Figure 5:
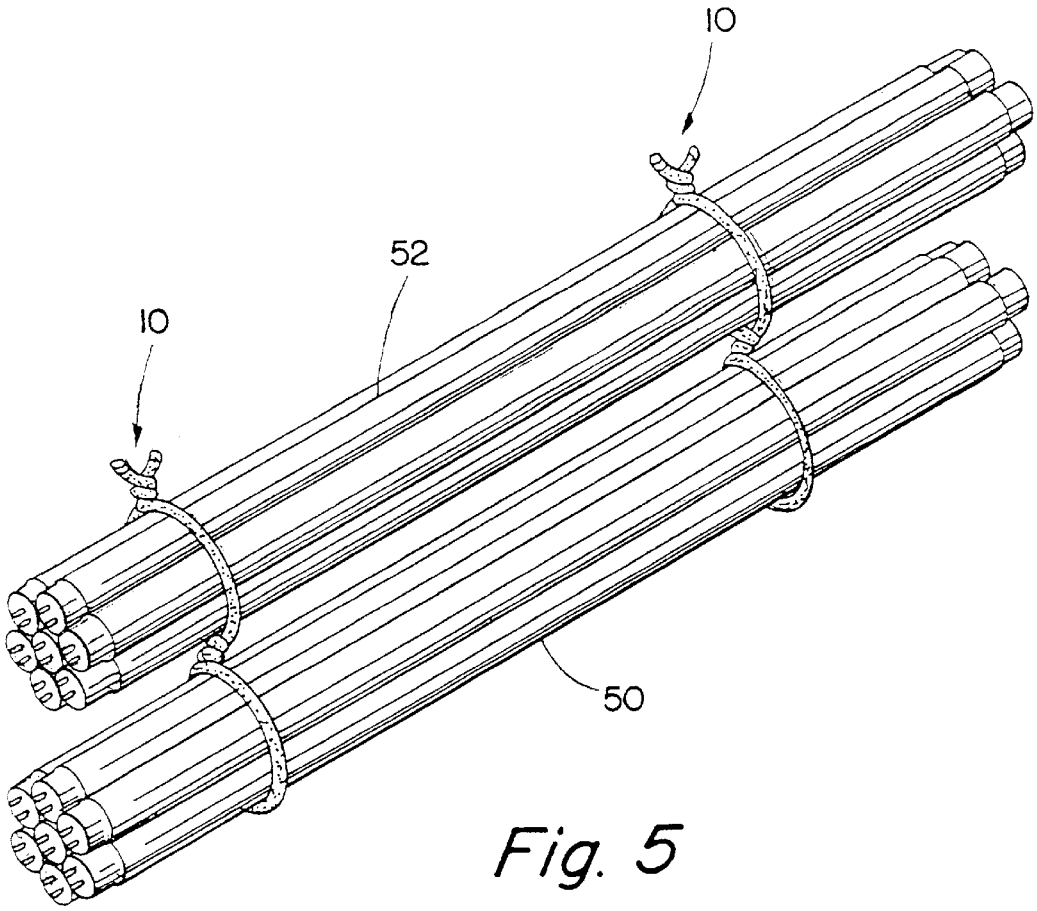
FIG. 5 is a perspective view of a preferred embodiment of the present invention in use as a bundling apparatus.

The preferred system herein described is not intended to be exhaustive or to limit the invention to the precise forms disclosed. They are chosen and described to explain the principles of the invention, and the application of the method to practical uses, so that others skilled in the art may practice the invention.

The present invention is comprised of a tube-like, elongate piece of first material 12 having characteristics including, but not limited to, soft, lightweight, and flexible qualities, such as found in sponge (or foam) rubber (any variation of first materials of the rubber-like variety would work well depending on the application and/or particular manufacturing technique). The tube-like, elongate piece 12 of first material encloses a flexible strip 14 of second material having characteristics including, but not limited to, flexible qualities that allow the strip 14 to retain its new shape when bent, such as a flexible wire. In the preferred embodiment, the tube-like, elongate piece 12 of first material is a sponge (or foam) rubber piece 12, and the flexible strip 14 of second material is a strip 14 of flexible metal.

Referring in more detail to the drawings, and particularly FIG. 1, a preferred embodiment of the snow ski wrap 10 of the present invention is comprised of a tube-like, elongate piece of sponge, or foam, rubber 12, a strip 14 of flexible metal enclosed within the length of the elongate piece of foam rubber 12, and a first end cap 16 placed over the first end 22 of the elongate piece of foam rubber 12, and a second end cap 18 placed over the opposite end 24 of the elongate piece of foam rubber 12.

It is preferred that the elongate piece of foam rubber 12 be formed of a long tube-like form, preferably between 10 to 50 inches long, as illustrated in FIG. 1. It is also preferred that the elongate piece of foam rubber 12 have a diameter between 0.5 inch to 2.5 inches so that the snow ski wrap 10 is capable of being easily grabbed and manipulated while a user is wearing heavy ski gloves. Several well known manufacturing methods may be used to produce the present invention. A preferred method is to co-extrude the rubber piece 12 onto the flexible strip 14.

The flexible strip 14 of metal can be easily bent, yet the strip 14 has a degree of rigidity which allows the snow ski wrap 10 to retain its form when bent or straightened. In a preferred embodiment, the strip 14 is a solid, 14 gauge, wire. FIG. 4 illustrates a cross-section of one end of the ski wrap 10, showing the enclosed strip 14 of wire.

The ski wrap 10 may be used by straightening the foam rubber piece 12 as illustrated in FIG. 1. Next the skier may place the two skis 20 together, as illustrated in FIG. 3. The skier may then take the ski wrap 10 of the present invention and grab the ends 22, 24 of the foam rubber piece 12 and wrap the elongate piece of foam rubber 12 around the first ends 26 of the two skis 20. The skier/user may then "twist-tie" the foam rubber piece 12 around the first ends 26 of the two skis. Twist-tying refers to interlocking the foam rubber piece 12 by twisting the ends 22, 24 of the foam rubber piece 12 together in the direction of the arrows 40 in FIG. 2. (The ends 22, 24 can also be twisted in the opposite direction of the arrows 40).

The skier/user may then wrap and twist-tie a second ski wrap 10 around the second ends 28 of the skis 20. This twist-tying motion creates a loop or hole 30 in which the skis 20 are secured. This twist-tying motion may also create a space 32 in which the ski poles 34 can be placed. The skier/user may then place a pair of ski poles 34 in the space 32 formed by the twist-tying of the elongate pieces of foam rubber 12. The ski poles 34 may be secured in place by wrapping and twist-tying the elongate pieces of foam rubber 12 a second time around the ends 36, 38 of the pair of ski poles 34.

The skier/user may carry the ski equipment by grasping the ski poles 34 between the first and second elongate pieces of foam rubber (42, 44 respectively).

The present invention is also unique as the elongate piece of foam rubber 12 has a non-slip exterior 46 in contact with the skis 20 and ski poles 34. The non-slip exterior 46 firmly secures the ski equipment in place to prevent the equipment from falling out of the loops 30. The foam rubber also protects the ski equipment from being scratched by the carrying means. Other known ski carrying equipment utilize straps made of leather, or other material, which can scratch the surface of the ski equipment. In the present invention, the insulation provided by the foam rubber protects the finished surfaces of the ski equipment from damage while in transit. Not only does the present invention prevent scratching from the ski carrier, the snow ski wrap 10 may be used to keep the snow skis 20 off the abrasive ground or pavement. A snow ski wrap 10 is preferably made with a foam rubber piece 12 with a radius 48 large enough to elevate the skis 20 off the hard ground.

The present invention has other beneficial uses. More particularly, the present invention is capable of being used for bundling and carrying elongate articles. For example, the present invention 10 is capable of separately bundling rods, baseball bats, sticks of wood, garden hoses or practically any other elongate article.

As illustrated, the present invention 10 may be used to bundle articles in separate groups. For example, as illustrated by FIG. 5, the first loop may be used to bundle and carry rods of one type 50 while the second loop may be used to bundle and carry rods of a second type 52. The present invention 10 is unique as it may be easily grabbed and manipulated while wearing heavy gloves. Additionally, the foam rubber exterior 46 preferably protects the bundled articles from being scratched by the carrying means. As discussed above, the foam rubber may also insulate the bundled elongate articles, such as the rods 50, 52 illustrated in FIG. 5, from damage when placed on the ground.

Figure 6:
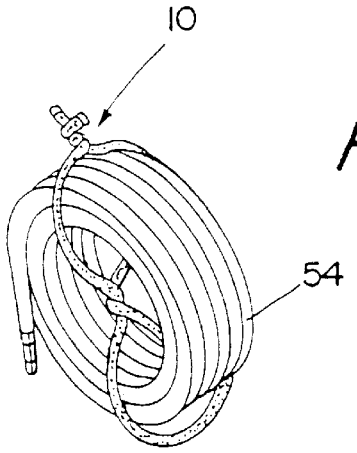
FIG. 6 is a perspective view of a preferred embodiment of the present invention in use as a garden hose restraint and carrying means.

FIG. 6 illustrates the present invention in use as a garden hose 54 restraint and carrying means. The present invention may also be used to secure items in place. For example, the present invention may be used to secure a bicycle to a bike rack.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. It is the intention, therefore, to limit the invention only as indicated by the scope of the claims.

What is claimed is:

1. An apparatus for securing articles, said apparatus comprising:

an elongate piece of first material having flexible qualities;

a strip of flexible material enclosed within the length of said elongate piece of first material;

a first end cap placed over a first end of said elongate piece of first material; and a second end cap placed over a second end of said elongate piece of first material;

wherein said strip of flexible material can be easily bent and has a degree of rigidity which allows said apparatus to retain its form when bent or straightened; and wherein said apparatus is adapted to be wrapped around a number of articles for securing said articles for storage or transport.

2. The apparatus of claim 1 wherein said strip of flexible material is comprised of a metal.

3. The apparatus of claim 1 wherein said elongate piece of first material is of a sufficient thickness to cause articles being carried therein to be removed from contact with a surface on which the articles may be placed.

4. The apparatus of claim 1 wherein said elongate piece of first material has a substantially non-slip exterior.

5. A method of securing a plurality of elongate articles, said method comprising the steps of:

providing a first flexible strip of material adapted to be easily bent, said first flexible strip of material having a degree of rigidity which allows said first flexible strip of material to retain its form when bent or straightened;

enclosing said first flexible strip of material with a first elongate piece of flexible material, said first elongate piece of flexible material comprised of a soft foam material;

wrapping said plurality of elongate articles with said first elongate piece of flexible material;

twist-tying said first elongate piece of flexible material around said plurality of elongate articles;

providing a second flexible strip of material adapted to be easily bent, said second flexible strip of material having a degree of rigidity which allows said second flexible strip of material to retain its form when bent or straightened;

enclosing said second flexible strip of material with a second elongate piece of flexible material;

wrapping said plurality of elongate articles with said second elongate piece of flexible material a predetermined distance from said first elongate piece of flexible material; and twist-tying said second elongate piece of flexible material.

6. A method of securing and transporting a plurality of elongate articles, said method comprising the steps of:

placing a plurality of elongate articles together;

wrapping and twist-tying a first elongate piece of flexible material around a first end of said plurality of elongate articles, said first elongate piece of flexible material enclosing a first flexible strip of material;

wrapping and twist-tying a second elongate piece of flexible material around a second end of said plurality of elongate articles, said second elongate piece of flexible material enclosing a second flexible strip of material;

grasping said plurality of elongate articles; and transporting said plurality of elongate articles.

7. The method of claim 6 wherein said plurality of elongate articles are grasped between said first and second elongate pieces of flexible material.

8. A method of handling a plurality of elongate articles, said method comprising the steps of:

placing a plurality of elongate articles together;

wrapping and securing a first elongate piece of flexible material around a first end of said plurality of elongate articles, said first elongate piece of flexible material enclosing and insulating a thinner first flexible strip of material; and wrapping and securing a second elongate piece of flexible material around a second end of said plurality of elongate articles, said second elongate piece of flexible material enclosing and insulating a thinner second flexible strip of material.

9. A system for securing articles, said system comprising:

a first elongate tie comprised of a first flexible material insulating member throughout the length of said first elongate tie and a second flexible material member, of a cross-section dimension less than said first flexible material member and a rigidity greater than said first flexible material, enclosed within the length of said first elongate tie;

a second elongate tie comprised of a third flexible material insulating member throughout the length of said second elongate tie and a fourth flexible material member, of a cross-section dimension less than said third flexible material member and a rigidity greater than said third flexible material, enclosed within the length of said second elongate tie;

wherein said first elongate tie and said second elongate tie are each at least ten inches in length and each arc adapted to be wrapped around at least two elongate articles to secure said articles.

10. The system of claim 9, wherein said first flexible material and said third flexible material are foam rubber.

11. The apparatus of claim 9, wherein said second flexible material and said fourth flexible material are metal strips.

* * * * *

UNITED STATES PATENT AND TRADEMARK OFFICE

CERTIFICATE OF CORRECTION

PATENT NO. : 6,113,170
DATED : September 5, 2000
INVENTOR(S) : Dianne C. Daniel

It is certified that error appears in the above-identified patent and that said Letters Patent is hereby corrected as shown below:

Column 6,
Line 22, please delete the word "arc" and replace it with --are--.

Signed and Sealed this

Seventeenth Day of July, 2001

*Attest:*

Nicholas P. Godici

*Attesting Officer*

NICHOLAS P. GODICI
*Acting Director of the United States Patent and Trademark Office*

US006113170C1

(12) EX PARTE REEXAMINATION CERTIFICATE (6514th)

United States Patent

Daniel

(10) Number: US 6,113,170 C1

(45) **Certificate Issued: *Nov. 11, 2008**

(54) WRAP FOR BUNDLING OBJECTS

(75) Inventor: Dianne C. Daniel, Dublin, OH (US)

(73) Assignee: Handle It LLC, Dublin, OH (US)

Reexamination Request:
No. 90/007,077, Jun. 15, 2004

Reexamination Certificate for:

| | |
|---|---|
| Patent No.: | **6,113,170** |
| Issued: | **Sep. 5, 2000** |
| Appl. No.: | **09/080,703** |
| Filed: | **May 18, 1998** |

( * ) Notice: This patent is subject to a terminal disclaimer.

Certificate of Correction issued Jul. 17, 2001.

Related U.S. Application Data

(63) Continuation of application No. 08/671,490, filed on Jun. 27, 1996, now Pat. No. 5,853,212.

(51) Int. Cl.
*A63C 11/00* (2006.01)
*A63C 11/02* (2006.01)

(52) U.S. Cl. ..... 294/147; 24/16 R; 294/141; 294/165

(58) Field of Classification Search ..... None
See application file for complete search history.

(56) References Cited

U.S. PATENT DOCUMENTS

| | | | | |
|---|---|---|---|---|
| 2,061,817 | A | 11/1936 | Van Cleef | |
| 2,118,875 | A | 5/1938 | Windheim | 224/5 |
| 2,530,695 | A | 11/1950 | Helmert | 224/5 |

(Continued)

OTHER PUBLICATIONS

Notice of Allowance mailed May 19, 2006, for U.S. Appl. No. 10/268/,142.
Issue fee paid in U.S. Appl. No. 10/268,142 on Aug. 21, 2006.
Amendment to U.S. Appl. No. 10/268,142, filed Apr. 14, 2006.
Amendment to U.S. Appl. No. 10/268,142, filed Oct. 5, 2004.
Interview Summary regarding U.S. Appl. No. 10/268,142 dated Oct. 5, 2004.
Verified Complaint for Damages and Injunctive Relief Jury Demand Endorsed Hereon and Civil Cover Sheet, *Handle It* v. *Kwiktwist, USDC—Eastern Texas,* Case 03CV310, dated Nov. 25, 2003.
Motion for Temporary Restraining Order and Preliminary Injunction, *Handle It* v. *Kwiktwist,* dated Nov. 25, 2003.
Defendant Kwiktwist Corporation's Answer, Affirmative Defenses, and Counterclaims, *Handle It* v. *Kwiktwist,* dated Dec. 18, 2003.
Plaintiff Handle It Limited Liability Company's Reply and Affirmative Defenses to Defendant's Counterclaims, *Handle It* v. *Kwiktwist,* dated Jan. 5, 2004.
Response to Plaintiff's Motion for Temporary Restraining Order and Preliminary Injuction, *Handle It* v. *Kwiktwist,* dated Jan. 2, 2004.
Order Denying Motion for Temporary Restraining Order and Preliminary Injunction, *Handle It* v. *Kwiktwist,* dated Feb. 13, 2004.

(Continued)

*Primary Examiner*—Peter C. English

(57) ABSTRACT

The present invention is an apparatus and method for bundling and carrying snow ski equipment. The present invention is comprised of an elongate piece of first material having flexible qualities with a flexible strip of second, more rigid, and bendable material enclosed within the first material. The apparatus may be twist-tied around ski equipment for relatively easy transport.

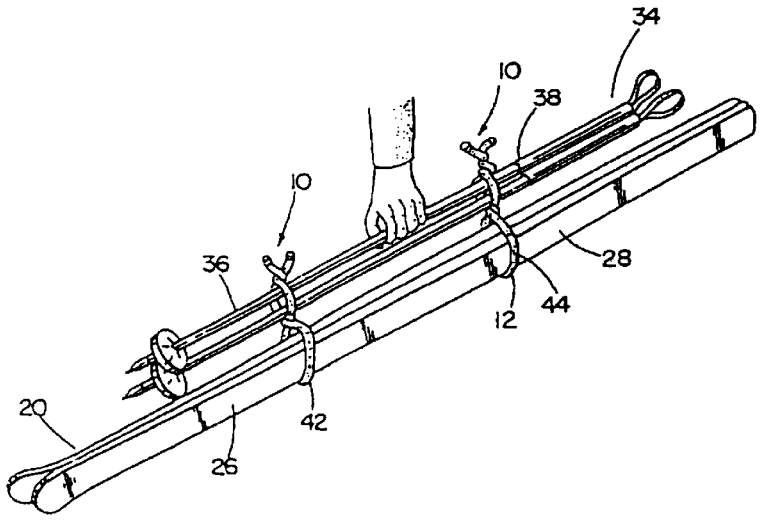

U.S. PATENT DOCUMENTS

| | | | | | |
|---|---|---|---|---|---|
| 2,542,601 | A | | 2/1951 | Van Cleef | |
| 3,257,054 | A | | 6/1966 | Miesel | 224/56 |
| 3,426,393 | A | * | 2/1969 | Mead | 24/30.5 T |
| 3,543,353 | A | * | 12/1970 | Meehan | 24/16 PB |
| 3,564,667 | A | * | 2/1971 | Parrick, III et al. | 280/814 |
| 3,757,429 | A | | 9/1973 | Sumino | 34/103 |
| 3,768,711 | A | | 10/1973 | Wilkinson | 224/45 |
| 3,947,927 | A | * | 4/1976 | Rosenthal | 24/16 R |
| 3,960,302 | A | | 6/1976 | Mazzoni | 224/45 S |
| 4,015,762 | A | | 4/1977 | Mendillo | 224/45 S |
| 4,120,437 | A | * | 10/1978 | Hara | 280/814 |
| 4,463,885 | A | | 8/1984 | Ball et al. | 224/250 |
| 4,483,470 | A | | 11/1984 | Cousins | 224/257 |
| 4,484,378 | A | | 11/1984 | Kimura et al. | 24/30.5 T |
| 4,488,748 | A | | 12/1984 | Burkes | 294/147 |
| 4,531,661 | A | | 7/1985 | Santy | 224/191 |
| 4,540,006 | A | | 9/1985 | Collis | 132/39 |
| 4,553,779 | A | | 11/1985 | Shortridge | 294/147 |
| 4,641,454 | A | * | 2/1987 | Ray et al. | 43/26 |
| 4,648,414 | A | * | 3/1987 | Fox et al. | 132/246 |
| 4,666,417 | A | | 5/1987 | Hillman | 446/267 |
| 4,817,837 | A | * | 4/1989 | Grover | 24/16 PB |
| 4,834,118 | A | | 5/1989 | Goeller | |
| 4,856,689 | A | | 8/1989 | Shore | 224/218 |
| 4,915,996 | A | | 4/1990 | Curry | |
| D310,909 | S | | 10/1990 | Bradtl | D3/36 |
| 5,054,299 | A | | 10/1991 | Maveety | 63/3 |
| 5,056,820 | A | | 10/1991 | Des Prez | 294/147 |
| 5,104,017 | A | | 4/1992 | Vandagriff | 224/205 |
| 5,190,336 | A | | 3/1993 | Palz | 294/147 |
| 5,199,135 | A | | 4/1993 | Gold | 294/147 |
| 5,234,370 | A | | 8/1993 | Shapero et al. | 446/394 |
| 5,437,401 | A | | 8/1995 | Seltzer | 224/151 |
| 5,468,036 | A | | 11/1995 | Brown | 294/147 |
| 5,498,190 | A | | 3/1996 | Ganson | 446/107 |
| 5,590,422 | A | | 1/1997 | Henderson | 132/273 |
| 5,664,589 | A | | 9/1997 | Black | 132/246 |
| 5,714,211 | A | | 2/1998 | Zinbarg et al. | |
| 5,769,994 | A | | 6/1998 | Booz et al. | |
| 5,916,006 | A | | 6/1999 | Ganson | |

OTHER PUBLICATIONS

Order Staying All Proceedings (pending determination of rexxamination), *Handle It* v. *Kwiktwist,* dated Aug. 17, 2004.

Office Action mailed Nov. 2, 2005, U.S. Appl. No. 10/268,142.

Response filed Jan. 17, 2006 to the Office Action mailed Nov. 2, 2005, Confimation Report from the USPTO that the response was received, U.S. Appl. No. 10/268,142.

Office Action mailed Mar. 31, 2005, U.S. Appl. No. 10/268,142.

In re Oetiker, 977 F.2d 1443, 24 USPQ2d 1443 (Fed. Cir. 1992).

Petition for Extension of Time and fee transmittal form filed on May 31, 2005, U.S. Appl. No. 10/268,142.

Office Action mailed Jun. 30, 2005, U.S. Appl. No. 10/268,142.

Amendment to Patent Application and fee transmittal form filed Sep. 30, 2005 in response to the Jun. 30, 2005 Examiner's Office Action, U.S. Appl. No. 10/268,142.

*Nystrom* v. *TREX Co. et al.,* No. 03–1092 (Fed. Cir. 2005), 76 USPQZd 1481.

Request for Continued Examination and U.S. Appl. No. 10/268,142, filed May 31, 2005 in response to Dec. 22, 2004 Examiner's Office Action.

Amendment to U.S. Appl. No. 10/268,142, filed Feb. 22, 2005 in reponse to Dec. 22, 2004 Examiner's Office Action.

File history of U.S Appl. No. 09/602,169, filed Jun. 22, 2000.

File history of U.S. Appl. No. 10/268,142, filed Oct. 9, 2002.

Actual embodiment of a Toober (cited in publications of underlying patent application by Daniel).

Actual embodiment of a Hair Twirler (cited in publications of underlying patent application by Daniel).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–11 are cancelled.

New claims 12–55 are added and determined to be patentable.

*12. A system for securing articles, said system comprising:*

*a first elongate tie comprised of a first flexible material insulating member throughout the length of said first elongate tie and a second flexible material member, of a cross-section dimension less than said first flexible material member and a rigidity greater than said first flexible material, enclosed within the length of said first elongate tie;*

*a second elongate tie comprised of a third flexible material insulating member throughout the length of said second elongate tie and a fourth flexible material member, of a cross-section dimension less than said third flexible material member and a rigidity greater than said third flexible material, enclosed within the length of said second elongate tie;*

*wherein said first elongate tie and said second elongate tie are each at least ten inches in length and each are adapted to be wrapped around at least two elongate articles to secure said articles.*

*wherein said first flexible material and said third flexible material are foam rubber, and*

*wherein said second flexible material is metal wire, the foam rubber of the first elongate tie directly abutting the metal wire.*

*13. The system of claim 12, wherein said fourth flexible material is metal wire, the foam rubber of the second elongate tie directly abutting the metal wire without a layer therebetween.*

*14. The system of claim 13, wherein the foam rubber of each of the first and second elongate ties includes a tubular shape having a length of at lest 10 inches to about 50 inches, wherein the metal wire of each of the first and second elongate ties is solid wire of about 14 gauge.*

*15. The system of claim 12, wherein the foam rubber of the first elongate tie engages the metal wire without an intermediate later therebetween.*

*16. An apparatus for securing articles, said apparatus comprising:*

*an elongate piece of first material having flexible qualities, the first material comprising foam rubber material;*

*a strip of flexible material enclosed within the length of said elongate piece of first material;*

*a first end cap placed over a first end of said elongate piece of first material; and*

*a second end cap placed over a second end of said elongate piece of first material;*

*wherein said strip of flexible material can be easily bent and has a degree of ridigity which allows said apparatus to retain its form when bent or straightened;*

*wherein said apparatus is adapted to be wrapped around a number of articles for securing said articles for storage or transport,*

*wherein said apparatus is at least ten inches in length so as to wrap around said article. for storage or transport, and*

*wherein the strip of flexible material is a metal wire, the foam rubber material directly abutting the metal wire.*

*17. The apparatus of claim 16, wherein the foam rubber material is defined by a tubular shape having a length of at least 10 inches to about 50 inches, wherein the metal wire is solid wire of about 14 gauge.*

*18. The apparatus of claim 16, wherein the foam rubber material engages the metal wire without an intermediate layer therebetween.*

*19. A method of handling a plurality of elongate articles, said method comprising the steps of:*

*placing a plurality of elongate articles together;*

*wrapping and securing a first elongate piece of flexible foam rubber material around a first end of said plurality of elongate articles, said first elongate piece of flexible foam rubber material enclosing and insulating a thinner first flexible strip of material, wherein said first elongate piece of flexible foam rubber material is at least ten inches in length, and wherein said first flexible strip of material comprises a metal wire, the first elongate piece of flexible foam rubber material directly abutting the metal wire; and*

*wrapping and securing a second elongate piece of flexible foam rubber material around a second end of said plurality of elongate articles, said second elongate piece of flexible foam rubber material enclosing and insulating a thinner second flexible strip of material, wherein said second elongate piece of flexible foam rubber material is at least ten inches in length.*

*20. The method of claim 19, wherein said second flexible strip of material comprises a metal wire, the second elongate piece of flexible foam rubber material directly abutting the metal wire without a layer therebetween.*

*21. The method of claim 20, wherein the first and second elongate pieces of flexible foam rubber material each have a tubular shape extending at least 10 inches to about 50 inches in length, wherein the first and second flexible strips of material each comprise solid wire of about 14 gauge.*

*22. The method of claim 19, wherein the first elongate piece of flexible foam rubber material engages the metal wire without an intermediate layer therebetween.*

*23. A system for securing articles, said system comprising:*

*a first elongate tie comprised of a first flexible foam insulating member throughout the length of said first elongate tie and a first flexible metal wire, of a cross-section dimension less than said first flexible foam member and a rigidity greater than said first flexible foam member, enclosed within the length of said first elongate tie; wherein the first flexible foam member directly abuts the first flexible metal wire without an intermediate layer therebetween,*

*a second elongate tie comprised of a second flexible foam insulating member throughout the length of said second elongate tie and a second flexible metal wire, of a cross-*

*section dimension less than said second flexible foam member and a rigidity greater than said second flexible foam member, enclosed within the length of said second elongate tie, wherein the second flexible foam member directly abuts the second flexible metal wire without an intermediate layer therebetween;*

*wherein said first elongate tie and said second elongate tie are each at least ten inches in length and each are adapted to be wrapped around at least two elongate articles to secure said articles.*

*24. The system of claim 23, wherein the flexible foam member of each of the first and second elongate ties has a tubular shape extending a length of at least 10 inches to about 50 inches, wherein the metal wire of each of the first and second elongate ties is solid wire of about 14 gauge.*

*25. The system of claim 23, wherein the first and second elongate ties are each approximately 50 inches in length.*

*26. The system of claim 23, wherein the first and second elongate ties are each approximately 2.5 inches in diameter.*

*27. The system of claim 23, wherein the first and second elongate ties are adapted to be physically wrapped around the at least two elongate articles in a non-slip, soft, and non-scratch engagement.*

*28. The system of claim 27, wherein the first and second elongate ties are adapted to be physically wrapped around the at least two elongate articles comprising an elongate piece of recreational equipment and an elongate piece of adjacent equipment.*

*29. The system of claim 28, wherein the first and second elongate ties are adapted to be physically wrapped around the recreational equipment comprising a first ski equipment and the adjacent equipment comprising a second ski equipment.*

*30. The system of claim 23, further comprising end caps arranged on free ends of each of the first and second elongate ties.*

*31. The system of claim 23, wherein the first and second elongate ties each have a length from at least 10 inches to about 50 inches.*

*32. The system of claim 31, wherein the first and second elongate ties each have a diameter between about 0.5 inches and about 2.5 inches.*

*33. The system of claim 23, wherein each of said first flexible foam member and said second flexible foam member comprises soft foam rubber.*

*34. An apparatus for securing articles, said apparatus comprising:*

*an elongate piece of foam material having flexible qualities;*

*a strip of flexible metal wire enclosed within the length of said elongate piece of foam material;*

*the foam material directly abutting the flexible metal wire without an intermediate layer therebetween;*

*a first end cap placed over a first end of said elongate piece of foam material; and*

*a second end cap placed over a second end of said elongate piece of foam material;*

*wherein said strip of flexible metal wire can be easily bent and has a degree of rigidity which allows said apparatus to retain its form when bent or straightened,*

*wherein said apparatus is at least ten inches in length and is adapted to be wrapped around a number of articles for securing said articles for storage or transport.*

*35. The apparatus of claim 34, wherein the elongate piece of foam material has a tubular shape that extends for a length of at least 10 inches to about 50 inches, wherein the strip of flexible metal wire comprises solid wire of about 14 gauge.*

*36. The apparatus of claim 34, wherein the elongate piece of foam material is approximately 50 inches in length.*

*37. The apparatus of claim 34, wherein the elongate piece of foam material is approximately 2.5 inches in diameter.*

*38. The apparatus of claim 34, wherein said apparatus is adapted to wrap around said articles in a non-slip, soft, and non-scratch engagement.*

*39. The apparatus of claim 38, wherein said apparatus is adapted to wrap around said articles comprising an elongate piece of recreational equipment and an elongate piece of adjacent equipment.*

*40. The apparatus of claim 39, wherein said apparatus is adapted to wrap around the recreational equipment comprising a first ski equipment and the adjacent equipment comprising a second ski equipment.*

*41. The apparatus of claim 34, wherein said apparatus has a length from at least 10 inches to about 50 inches.*

*42. The apparatus of claim 41, wherein said apparatus has a diameter between about 0.5 inches and about 2.5 inches.*

*43. The apparatus of claim 34, wherein the elongate piece of foam material is of a sufficient thickness to cause articles being carried therein to be removed from contact with a surface on which the articles may be disposed.*

*44. The apparatus of claim 34, wherein the elongate piece of foam material has a substantially non-slip exterior.*

*45. The apparatus of claim 34, wherein the elongate piece of foam material comprises soft foam rubber.*

*46. A method of handling a plurality of elongate articles, said method comprising the steps of:*

*placing a plurality of elongate articles of recreational equipment together; wrapping and securing a first elongate piece of flexible foam material around a first end of said plurality of elongate articles of recreational equipment, said first elongate piece of flexible foam material enclosing and insulating a thinner first flexible strip of metal wire, said first elongate piece of flexible foam material directly abutting the first flexible strip of metal wire without an intermediate layer therebetween, wherein said first elongate piece of flexible foam material is at least ten inches in length; and*

*wrapping and securing a second elongate piece of flexible foam material around a second end of said plurality of elongate articles of recreational equipment, said second elongate piece of flexible foam material enclosing and insulating a thinner second flexible strip of metal wire, said second elongate piece of flexible foam material directly abutting the second flexible strip of metal wire without an intermediate layer therebetween, wherein said second elongate piece of flexible foam material is at least ten inches in length.*

*47. The method of claim 46, wherein the first and second elongate pieces of flexible foam material are wrapped around said plurality of elongate articles in a non-slip, soft, and non-scratch engagement.*

*48. The method of claim 47, wherein said plurality of elongate articles comprise an elongate piece of recreational equipment and an elongate piece of adjacent equipment.*

*49. The method of claim 48, wherein the recreational equipment comprises a first ski equipment and wherein the adjacent equipment comprises a second ski equipment.*

*50. The method of claim 46, wherein the first and second elongate pieces of flexible foam material each have a tubular shape extending at least 10 inches to about 50 inches in length, wherein the first and second flexible strips of metal wire each comprises solid wire of about 14 gauge.*

*51. The method of claim 46, wherein the first and second elongate pieces of flexible foam material are each approximately 50 inches in length.*

*52. The method of claim 46, wherein the first and second elongate pieces of flexible foam material are each approximately 2.5 inches in diameter.*

*53. The method of claim 46, wherein each of the first and second elongate pieces of flexible foam material have end caps arranged on free ends thereof.*

*54. The method of claim 46, wherein the first and second elongate pieces of flexible foam material each have a length from at least 10 inches to about 50 inches.*

*55. The method of claim 54, wherein the first and second elongate pieces of flexible foam material each have a diameter between about 0.5 inches and about 2.5 inches.*

* * * * *